US007764912B2

(12) United States Patent
Kondo et al.

(10) Patent No.: US 7,764,912 B2
(45) Date of Patent: Jul. 27, 2010

(54) DEVELOPER AMOUNT REGULATION BLADE STRUCTURE

(75) Inventors: Takafumi Kondo, Atsugi (JP); Atsuhiko Ogawa, Atsugi (JP)

(73) Assignee: Ricoh Company Ltd., Tokyo (JP)

( * ) Notice: Subject to any disclaimer, the term of this patent is extended or adjusted under 35 U.S.C. 154(b) by 374 days.

(21) Appl. No.: 11/851,905

(22) Filed: Sep. 7, 2007

(65) Prior Publication Data

US 2008/0063439 A1 Mar. 13, 2008

(30) Foreign Application Priority Data

Sep. 7, 2006 (JP) ..... 2006-242338

(51) Int. Cl.
*G03G 15/08* (2006.01)

(52) U.S. Cl. ..... 399/284

(58) Field of Classification Search ..... 399/274, 399/284, 286

See application file for complete search history.

(56) References Cited

U.S. PATENT DOCUMENTS

| | | | |
|---|---|---|---|
| 2004/0055841 | A1 | 3/2004 | Tomiyama |
| 2005/0047814 | A1 | 3/2005 | Kawai |

FOREIGN PATENT DOCUMENTS

| | | | |
|---|---|---|---|
| EP | 1 253 485 | A2 | 10/2002 |
| JP | 60-103368 | | 6/1985 |
| JP | 2000-155464 | | 6/2000 |
| JP | 2001-356592 | | 12/2001 |
| JP | 2003-280364 | | 10/2003 |
| JP | 2003-280475 | | 10/2003 |
| JP | 2004-139019 | | 5/2004 |
| JP | 2006-39430 | | 2/2006 |
| JP | 2006-39431 | | 2/2006 |
| JP | 3793370 | | 4/2006 |
| WO | WO 2006/038375 | A1 | 4/2006 |

*Primary Examiner*—Hoang Ngo
(74) *Attorney, Agent, or Firm*—Oblon, Spivak, McClelland, Maier & Neustadt, L.L.P.

(57) ABSTRACT

A developer amount regulation blade structure that effectively reduces assembly cost and improves image quality configured to form a layer of a developer on a developer bearer includes a regulation blade configured to regulate a thickness of the developer on the developer bearer, a first supporting member configured to support the regulation blade maintaining a gap between the regulation blade and the developer bearer, and a second supporting member configured to sandwich the regulation blade tightly with the first supporting member, wherein at least one of the first supporting member and the second supporting member is made of a plastically deformable material, and the second supporting member and the first supporting member sandwich the regulation blade by at least two plastically deformed portions separated from each other in a longitudinal direction of the first supporting member and connecting the first supporting member and the second supporting member.

17 Claims, 6 Drawing Sheets

DEVELOPER AMOUNT REGULATION BLADE STRUCTURE

PRIORITY STATEMENT

The present patent application claims priority under 35 U.S.C. §119 from Japanese Patent Application No. 2006-242338, filed in the Japan Patent Office on Sep. 7, 2006, the content and disclosure of which are hereby incorporated by reference herein in their entirety.

BACKGROUND OF THE INVENTION

1. Field of the Invention

The present disclosure generally relates to a developer amount regulation blade structure used in an image forming apparatus, for example, printers, facsimiles, copiers, and multifunctional machines including functions of printer, facsimile, and copier.

2. Discussion of the Related Art

A conventional image forming apparatus has a developing apparatus which includes a developer bearer (a developing roller) and a developer amount regulation blade structure. The developer bearer (developing roller) attracts a two-component developer including a toner and a magnetic carrier or a one-component developer including a toner by magnetic force of a magnet roller and supplies the developer to a latent image bearer. The developer amount regulation blade structure faces the developer bearer and supplies the developer to the latent image bearer. A regulation blade, which is a thin board member, is provided on the developer amount regulation blade structure.

The regulation blade regulates the amount of the developer supported on the surface of the developer bearer. In a one-component type developer, for example, the regulation blade such as blade springs is pressed against the surface of the developer bearer. Therefore, the amount of the developer on the surface of the developer bearer is regulated by the regulation blade.

As with the developing apparatus, in order to make the developer bearer be supplied uniformly with the developer in a longitudinal direction of the developer bearer, it is necessary that the regulation blade be pressed with a uniform force in the longitudinal direction. Therefore, uniform flatness is required of the regulation blade.

FIG. 1 is a cross-sectional diagram illustrating an exemplary configuration of a developer amount regulation blade structure of a conventional image forming apparatus. As shown in FIG. 1, a supporting member 2 faces a developer bearer 1. Screws 4 located along a regulation blade 3 fix the regulation blade 3 on the supporting member 2. The regulation blade 3 is in touch with the surface of the developer bearer 1 by a given pressing force F.

However, this type of the regulation blade 3 has a waveform in the longitudinal direction, and therefore fails to achieve the straight edge intended by design. As a result, a gap between the developer bearer 1 and the regulation blade 3 is uneven and consequently good frictional electrification is not obtained, resulting in production of defective images in image formation.

For the straightness of the edge of the regulation blade 3, it is considered that it is good to increase the pressing force F. However, the increase of the pressing force F may cause the regulation blade 3 to scratch the developer bearer 1, in which case a lifetime of the development bearer 1 may decrease.

To fix this problem, a developer amount regulation blade structure in which a bolting torque gradually decreases toward a center of the regulation blade 3 from the both ends thereof when the regulation blade 3 is fixed on the supporting member 2 is proposed.

In addition, a developer amount regulation blade structure in which a thin regulation blade is fixed on the supporting member 2 by welding is also proposed.

SUMMARY OF THE INVENTION

An embodiment of the present invention is directed to a developer amount regulation blade structure. The developer amount regulation blade structure effectively reduces assembly cost and improves image quality. In the embodiment, the developer amount regulation blade structure configured to form a layer of a developer on a developer bearer includes a regulation blade configured to regulate a thickness of the developer on the developer bearer, a first supporting member configured to support the regulation blade maintaining a gap between the regulation blade and the developer bearer, and a second supporting member configured to sandwich the regulation blade tightly with the first supporting member, wherein at least one of the first supporting member and the second supporting member is made of a plastically deformable material, and the second supporting member and the first supporting member sandwich the regulation blade by at least two plastically deformed portions separated from each other in a longitudinal direction of the first supporting member and connecting the first supporting member and the second supporting member.

Additional features and advantages of the present invention will be more fully apparent from the following detailed description of embodiments, the accompanying drawings, and the appended claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
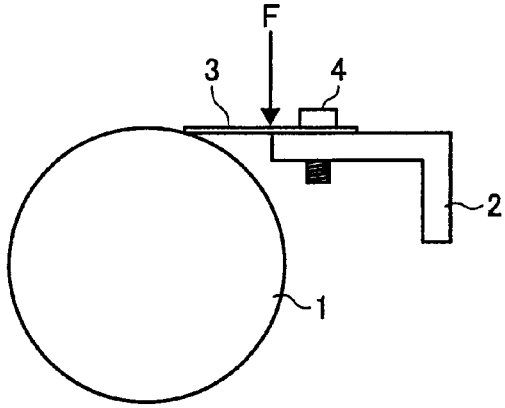
FIG. 1 PRIOR ART
FIG. 1 is a cross-sectional diagram showing a configuration of a developer amount regulation blade structure of a conventional image forming apparatus.

Referring now to the drawings, wherein like reference numerals designate identical or corresponding parts throughout the several views, embodiments of the present disclosure, which are applied to a developer amount regulation blade structure, are described below.

In the following description, it is to be understood that if an element or layer is referred to as being "on," "against," "connected to" or "coupled to" another element or layer, then it may be either directly on, against, connected or coupled to that other element or layer or intervening elements or layers may be present. By contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
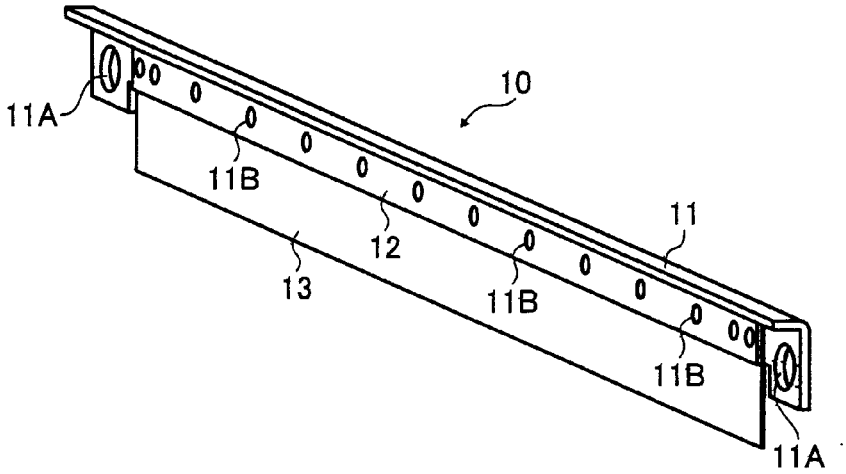
FIG. 2 is a perspective diagram showing a developer amount regulation blade structure of an image forming apparatus according to an embodiment of the present invention.

Referring now to the drawings, particularly to FIG. 2, an example of a developer amount regulation blade structure of an image forming apparatus according to embodiments is described.

EXAMPLE 1

Figure 3:
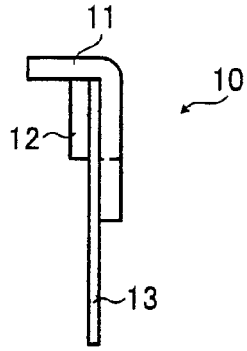
FIG. 3 is a cross-sectional diagram showing a configuration of the developer amount regulation blade structure of FIG. 2.
Figure 4:
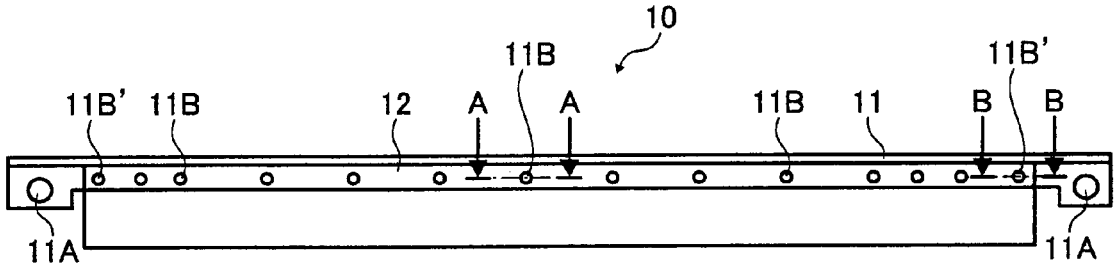
FIG. 4 is a front view showing a configuration of the developer amount regulation blade structure of FIG. 2.
Figure 5:
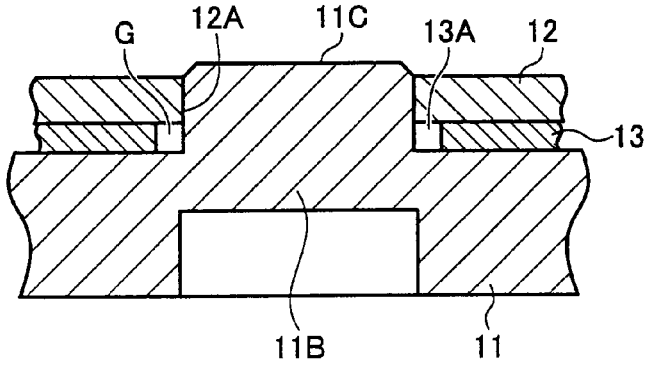
FIG. 5 is a fragmentary sectional view along a line A-A of the developer amount regulation blade structure of FIG. 4.
Figure 6:
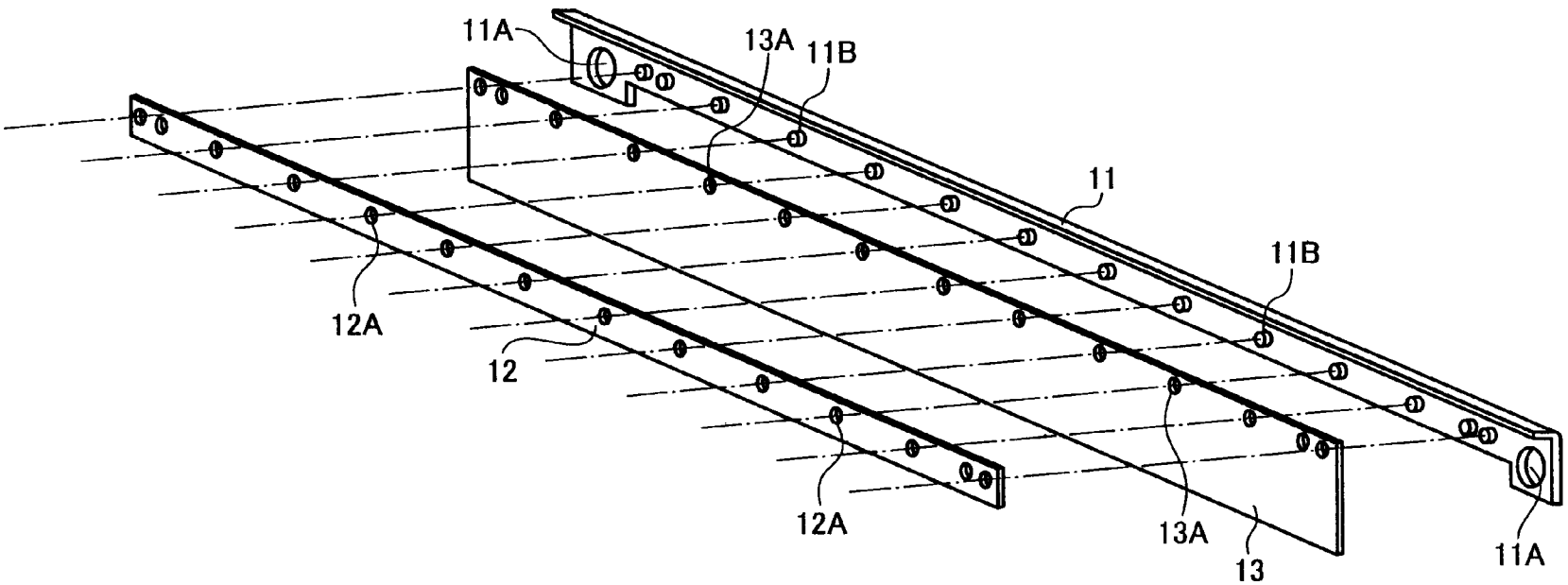
FIG. 6 is an exploded perspective view of the developer amount regulation blade structure of FIG. 2.

FIG. 2 is a perspective diagram of a developer amount regulation blade structure of an image forming apparatus according to an example embodiment of the present invention. FIG. 3 is a cross-sectional diagram illustrating an exemplary configuration of the developer amount regulation blade structure of FIG. 2. FIG. 4 is a front view illustrating an exemplary configuration of the developer amount regulation blade structure of FIG. 2. FIG. 5 is a fragmentary sectional view along a line A-A of the developer amount regulation blade structure of FIG. 4. FIG. 6 is an exploded perspective view of the developer amount regulation blade structure of FIG. 2.

In FIG. 2, reference numeral 10 shows the developer amount regulation blade structure. The developer amount regulation blade structure 10 includes a first supporting member 11, a second supporting member 12, and a thin regulation blade 13. The first supporting member 11, the second supporting member 12, and the thin regulation blade 13 are constituted of materials which can plastically deform, and they extend along a developer bearer (not shown).

As shown in FIG. 4, screw holes 11A are formed at both ends of the first supporting member 11 for fixing the developer amount regulation blade structure 10 in the main body of the image forming apparatus (not shown).

Half die cutting cylindrical projections 11B shown in FIG. 5 are formed on the first supporting member 11 having a given interval in a longitudinal direction. These cylindrical projections 11B are formed on the first supporting member 11 using, for example, a press metal mold (not shown). It is desirable that the cylindrical projections 11B be spaced regular intervals apart.

Penetration holes 13A having a diameter greater than an outer diameter of the cylindrical projections 11B are formed in the regulation blade 13 at positions corresponding to the cylindrical projections 11B. Penetration holes 12A having a diameter smaller than the outer diameter of the cylindrical projections 11B are formed in the second supporting member 12 at positions corresponding to the cylindrical projections 11B. The regulation blade 13 is arranged between the first supporting member 11 and the second supporting member 12, as shown in FIG. 6. The regulation blade 13 is tightened between the first supporting member 11 and the second supporting member 12 by pressing the cylindrical projections 11B into the penetration holes 12A, as shown in FIG. 5.

In this example 1, the developer amount regulation blade structure 10 has a structure such that the regulation blade 13 is tightened between the first supporting member 11 and the second supporting member 12 by pressing the cylindrical projections 11B into the penetration holes 12A. Therefore, it is inexpensive to assemble the developer amount regulation blade structure 10 and its working efficiency is improved. Further, it is not easily susceptible to the influence of changes in environment even if different materials are used in assembly, and it has a good flatness.

When the regulation blade 13 has a thickness of 0.1 mm or smaller, the regulation blade 13 is pressed against the first supporting member 11 with the second supporting member 12 by plastic deformation of heads 11C of the cylindrical projections 11B due to applied external force. Since the peripheral wall of the penetration holes 12A of the second supporting member 12 deforms by the plastic deformation of the cylindrical projections 11B, the portions of the regulation blade 13 corresponding to the peripheral wall of the penetration holes 12A may deform to have a waveform. However, in this example 1, the heads 11C of the cylindrical projections 11B do not plastically deform, thus assuring that the regulation blade 13 is flat.

When the regulation blade 13, the first supporting member 11, and the second supporting member 12 are made of different materials, coefficients of linear expansion thereof are different. However, a gap G exists between the penetration holes 13A of the regulation blade 13 and the cylindrical projections 11B to accommodate differences in the coefficients of linear expansion of such different materials. Since the gap G prevents growth and shrinkage of the first supporting member 11 brought about by temperature change from being transmitted to the regulation blade 13, waveform of the regulation blade 13 due to such temperature change is reduced.

In this example 1, the first supporting member 11 has 12 cylindrical projections 11B. However, at least 2 cylindrical projections 11B are enough to assemble the developer amount regulation blade structure 10.

In this example 1, the first supporting member 11 has the cylindrical projections 11B and the penetration holes 12A are formed in the second supporting member 12. Alternatively, however, the second supporting member 12 may have the cylindrical projections, with the penetration holes formed in the first supporting member 11.

EXAMPLE 2

Figure 7:
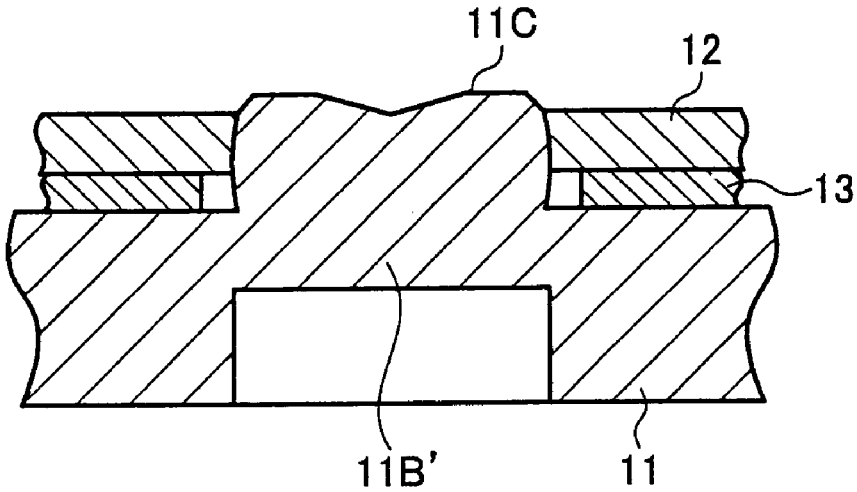
FIG. 7 is a fragmentary sectional view along a line B-B of the developer amount regulation blade structure of FIG. 4.

FIG. 7 is a fragmentary sectional view along a line B-B of the developer amount regulation blade structure of FIG. 4. In this example 2, cylindrical projections 11B' are provided at both ends of the cylindrical projections 11B of the example 1. The heads 11C of the cylindrical projections 11B' are plastically deformed by a punch member (not shown) as shown in FIG. 7. In this example 2, the heads 11C of the cylindrical projections 11B' has plastic deformation and they are fitted in the second supporting member 12. Therefore, the second supporting member 12 is hard to be separated from the first supporting member 11.

Even if the heads 11C of the cylindrical projections 11B' plastically deform and they are fitted into the second supporting member 12, and the regulation blade 13 is pressed against the first supporting member 11 with the second supporting member 12 by such plastic deformation, the flatness of the regulation blade 13 is not affected because the cylindrical projections 11B' are located at both end portions.

In this example 2, the first supporting member 11 has 12 cylindrical projections 11B. However, at least 3 cylindrical projections 11B are enough to assemble the developer amount regulation blade structure 10, and the cylindrical projections 11B at both end portions have enough plastic deformation to enable them to be attached.

EXAMPLE 3

Figure 8:
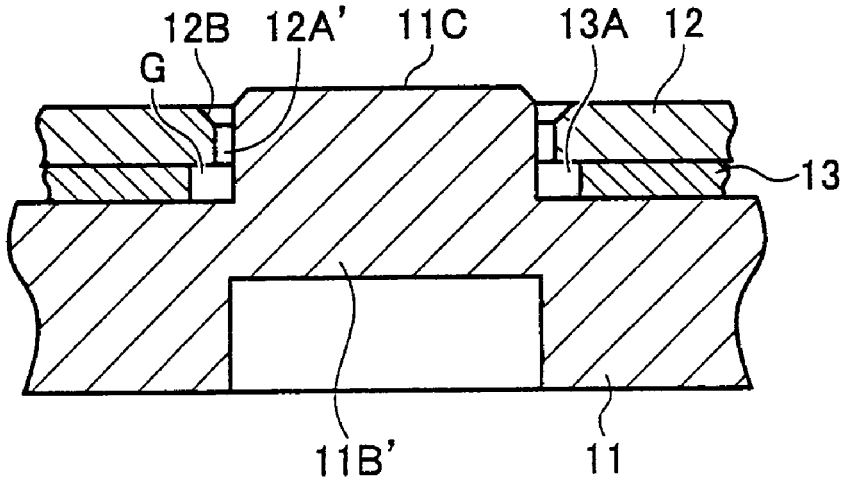
FIG. 8 is a fragmentary sectional view of the developer amount regulation blade structure of FIG. 4 before plastic deformation of cylindrical projections.
Figure 9:
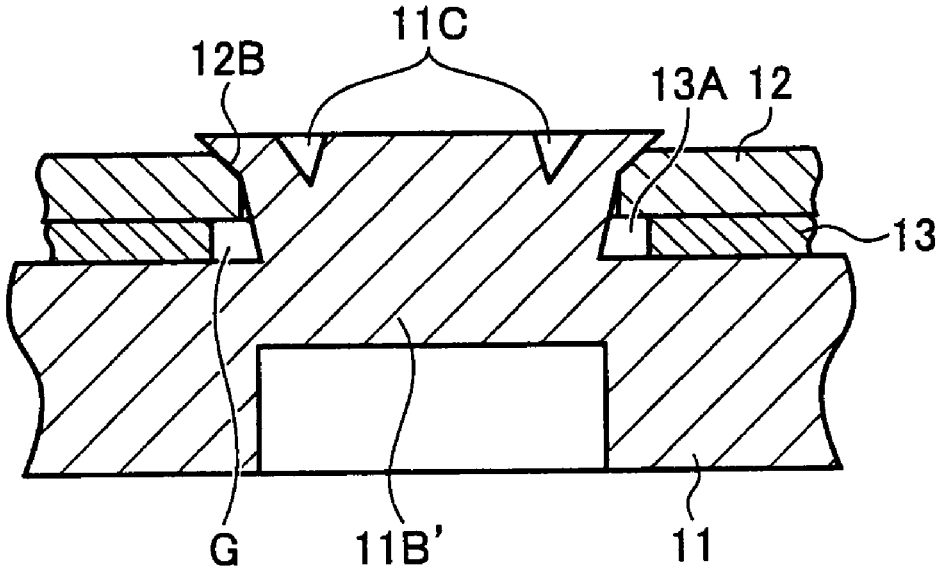
FIG. 9 is a fragmentary sectional view of the developer amount regulation blade structure of FIG. 4 after plastic deformation of the cylindrical projections.

FIG. 8 is a fragmentary sectional view of the developer amount regulation blade structure of FIG. 4 before plastic deformation of cylindrical projections. FIG. 9 is a fragmentary sectional view of the developer amount regulation blade structure of FIG. 4 after plastic deformation of cylindrical projections. In example 3, as shown in FIG. 8, the penetration holes 12A' having a diameter greater than an outer diameter of the cylindrical projections 11B' are formed in the second supporting member 12 at positions corresponding to the cylindrical projections 11B'. Further, a beveling portion 12B is formed in the penetration hole 12A'. As shown in FIG. 9, the heads 11C corresponding to the cylindrical projections 11B' deform so as to extrude outside and pressing in the second supporting member 12. Therefore, compared to example 2, the regulation blade 13 is firmly fixed to the first supporting member 11 without affecting the flatness of the regulation blade 13. Because the cylindrical projections 11B' are located at both ends of the developer amount regulation blade structure they do not affect the flatness of the regulation blade 13 even though they deform.

In this example 3, the first supporting member 11 has the cylindrical projections 11B and the penetration holes 12A are formed in the second supporting member 12. Alternatively, however, the second supporting member 12 may have the cylindrical projections and the penetration holes may be formed in the first supporting member 11.

Moreover, although in this example 3 the beveling part 12B is provided in the penetration hole 12A', it is not necessary that such beveling part 12B be provided in the penetration hole 12A'.

EXAMPLE 4

Figure 10:
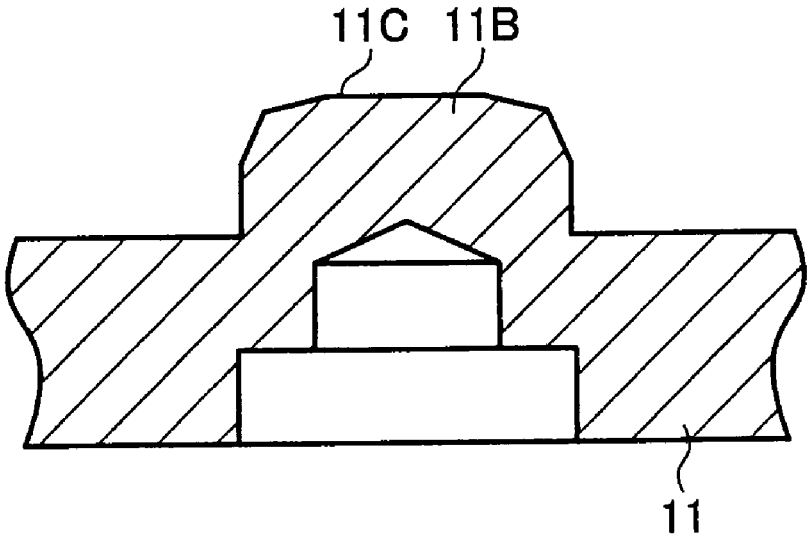
FIG. 10 is a fragmentary sectional view of another example of the developer amount regulation blade structure of FIG. 4.
Figure 11:
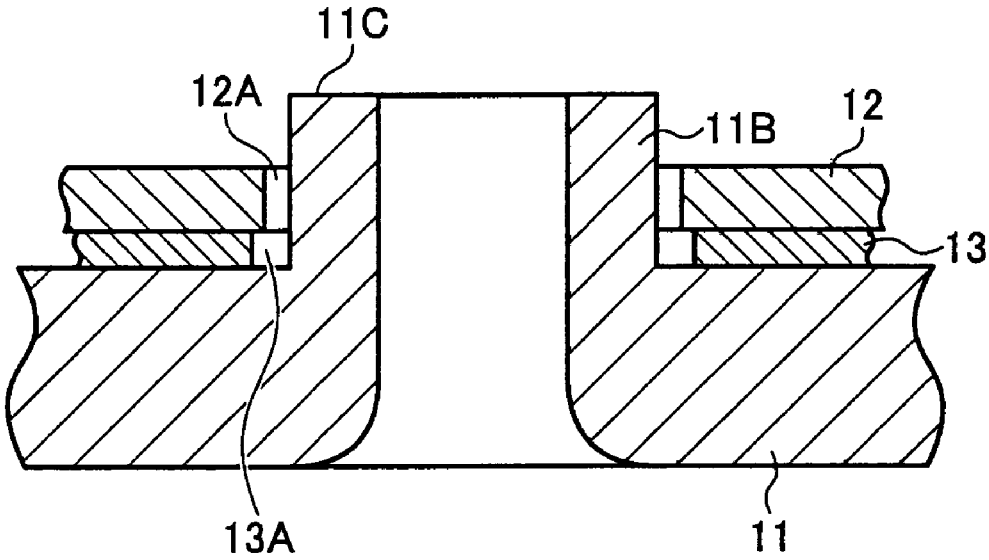
FIG. 11 is a fragmentary sectional view of another example of the developer amount regulation blade structure of FIG. 4.
Figure 12:
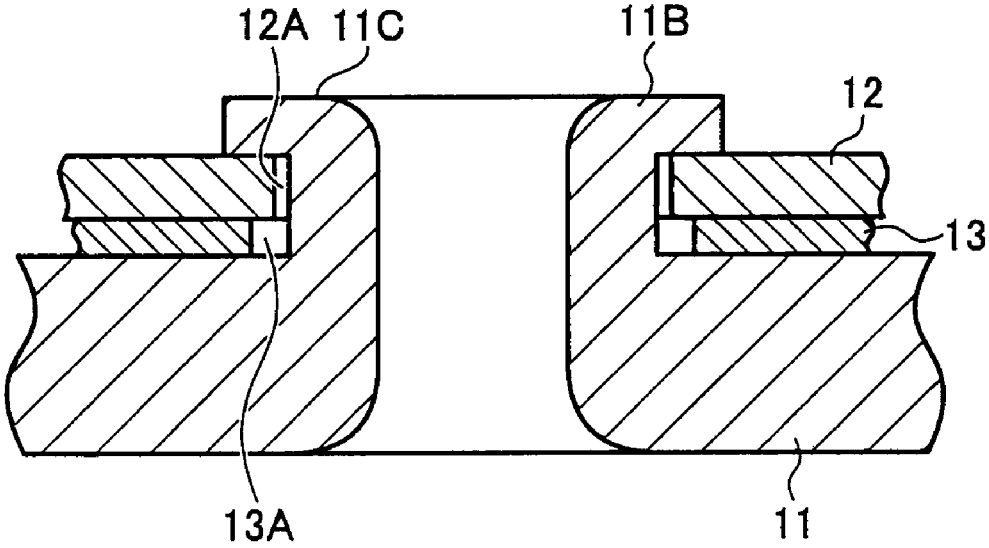
FIG. 12 is a fragmentary sectional view of another example of the developer amount regulation blade structure of FIG. 4.

FIG. 10 is a fragmentary sectional view of another example of the developer amount regulation blade structure of FIG. 4. FIG. 11 is a fragmentary sectional view of another example of the developer amount regulation blade structure of FIG. 4. FIG. 12 is a fragmentary sectional view of another example of the developer amount regulation blade structure of FIG. 4.

In example 3 described above, the cylindrical projections 11B are formed by press processing. On the other hand, as shown in FIG. 10, the cylindrical projections 11B are formed by emboss processing. In example 4, the cylindrical projections 11B are formed by burring processing. Mild steel plate, e.g., galvanized sheet iron is used for forming the first supporting member 11 and the second supporting member 12. A SUS may be used for forming the second supporting member 12. The penetration holes 12A having a diameter greater than an outer diameter of the cylindrical projections 11B and having a diameter smaller than a diameter of the penetration holes 13A are formed in the second supporting member 12 at positions corresponding to the cylindrical projections 11B. The penetration holes 13A having a diameter greater than the outer diameter of the cylindrical projections 11B are formed in the regulation blade 13 at the positions corresponding to the cylindrical projections 11B.

The regulation blade 13 is located between the first supporting member 11 and the second supporting member 12. As shown in FIG. 12, the heads 11C of the cylindrical projections 11B deforms to extrude outside by punch processing (not shown). Therefore, the regulation blade 13 is tightened between the first supporting member 11 and the second supporting member 12. Openings of the cylindrical projections 11B are covered with a strip of tape to prevent attachment of toner.

In this example 4, the first supporting member 11 has the cylindrical projections 11B and the penetration holes 12A are formed in the second supporting member 12. Alternatively, however, the second supporting member 12 may have the cylindrical projections 11B and the penetration holes 12A may be formed in the first supporting member 11.

It should be noted that, in the above-described embodiments, descriptions are provided using examples in which the subject matter of the present disclosure is applied to the electrophotographic image forming apparatus. However, it is to be understood that the subject matter of the present disclosure may be applied to other image forming apparatuses such as printers, facsimiles and so forth, and also to a multi-functional image forming apparatus.

The embodiments being thus described, it should be apparent to one skilled in the art after reading this patent specification that the same may be varied in many ways. Such variations are not to be regarded as a departure from the spirit and scope of the present disclosure, and all such modifications as would be apparent to one skilled in the art are intended to be included within the scope of the following claims.

What is claimed is:

1. A developer amount regulation blade structure configured to form a layer of a developer on a developer bearer, comprising:

a regulation blade configured to regulate a thickness of the developer on the developer bearer, wherein the regulation blade extends in a longitudinal direction of the developer bearer;

a first supporting member configured to support the regulation blade while maintaining a gap between the regulation blade and the developer bearer; and a second supporting member configured to sandwich the regulation blade tightly with the first supporting member, wherein at least one of the first supporting member and the second supporting member is made of a plastically deformable material, and the second supporting member and the first supporting member sandwich the regulation blade by at least two plastically deformed portions separated from each other in a longitudinal direction of the first supporting member and connecting the first supporting member and the second supporting member, and wherein the first supporting member includes at least two cylindrical projections that extend from the first supporting member and that are separated from each other in a longitudinal direction of the first supporting member.

2. The developer amount regulation blade structure of claim 1, wherein:

penetration holes having a diameter greater than an outer diameter of the cylindrical projections are formed in the regulation blade at positions corresponding to the cylindrical projections, penetration holes having a diameter smaller than the outer diameter of the cylindrical projections are formed in the second supporting member at the positions corresponding to the cylindrical projections, and the regulation blade being tightened between the first supporting member and the second supporting member by pressing the cylindrical projections in the penetration holes of the second supporting member through the penetration holes of the regulation blade, such that the penetration holes of the second supporting member are plastically deformed.

3. The developer amount regulation blade structure of claim 2, wherein heads of the cylindrical projections are plastically deformed by punching.

4. The developer amount regulation blade structure of claim 2, wherein the first supporting member has at least three cylindrical projections separated from each other in a longitudinal direction of the first supporting member, and the cylindrical projections are spaced regular intervals apart.

5. The developer amount regulation blade structure of claim 1, wherein:

the first supporting member has at least three cylindrical projections separated from each other in a longitudinal direction of the first supporting member, penetration holes having a diameter greater than an outer diameter of the cylindrical projections are formed in the regulation blade at the positions corresponding to the cylindrical projections, penetration holes having a diameter smaller than the outer diameter of the cylindrical projections are formed in the second supporting member at the positions corresponding to the cylindrical projections, the regulation blade being tightened between the first supporting member and the second supporting member by pressing the cylindrical projections in the penetration holes of the second supporting member through the penetration holes of the regulation blade, and the penetration holes of the second supporting member and at least two end cylindrical projections of the at least three cylindrical projections are plastically deformed.

6. The developer amount regulation blade structure of claim 2, wherein the first and second supporting members are each made of different materials such that coefficients of linear expansion thereof are different, and a gap is formed between the cylindrical projections and the penetration holes of the regulation blade.

7. The developer amount regulation blade structure of claim 1, wherein:

penetration holes having a diameter greater than an outer diameter of the cylindrical projections are formed in the regulation blade and the second supporting member at the positions corresponding to the cylindrical projections, and the regulation blade being tightened between the first supporting member and the second supporting member by inserting the cylindrical projections in the penetration holes of the second supporting member through the penetration holes of the regulation blade and by plastic deformation of heads of the cylindrical projections.

8. The developer amount regulation blade structure of claim 7, wherein beveling portions are formed in the penetration holes of the second supporting member at the opposite side of the regulation blade, and heads of the cylindrical projections of the first supporting member are plastically deformed to cover the beveling portions.

9. The developer amount regulation blade structure of claim 1, wherein:

the at least two cylindrical projections are formed by burring processing, penetration holes having a diameter greater than an outer diameter of the cylindrical projections are formed in the regulation blade and the second supporting member at the positions corresponding to the cylindrical projections, and the regulation blade being tightened between the first supporting member and the second supporting member by inserting the cylindrical projections in the penetration holes of the second supporting member through the penetration holes of the regulation blade and by plastic deformation of heads of the cylindrical projections.

10. The developer amount regulation blade structure of claim 9, wherein the cylindrical projections are spaced regular intervals apart.

11. A developer amount regulation blade structure configured to form a layer of a developer on a developer bearer, comprising:

a regulation blade configured to regulate a thickness of the developer on the developer bearer, wherein the regulation blade extends in a longitudinal direction of the developer bearer;

a first supporting member configured to support the regulation blade while maintaining a gap between the regulation blade and the developer bearer; and a second supporting member configured to sandwich the regulation blade tightly with the first supporting member, wherein at least one of the first supporting member and the second supporting member is made of a plastically deformable material, and the second supporting member and the first supporting member sandwich the regulation blade by at least two plastically deformed portions separated from each other in a longitudinal direction of the first supporting member and connecting the first supporting member and the second supporting member, and wherein the second supporting member includes at least two cylindrical projections that extend from the second supporting member and that are separated from each other in a longitudinal direction of the second supporting member.

12. The developer amount regulation blade structure of claim 11, wherein:

penetration holes having a diameter greater than the outer diameter of the cylindrical projections are formed in the regulation blade at the positions corresponding to the cylindrical projections, penetration holes having a diameter smaller than the outer diameter of the cylindrical projections are formed in the first supporting member at the positions corresponding to the cylindrical projections, and the regulation blade being tightened between the first supporting member and the second supporting member by pressing the cylindrical projections in the penetration holes of the first supporting member through the penetration holes of the regulation blade, such that the penetration holes of the first supporting member are plastically deformed.

13. The developer amount regulation blade structure of claim 12, wherein the first and second supporting members are each made of different materials such that coefficients of linear expansion thereof are different, and a gap is formed between the cylindrical projections and the penetration holes of the regulation blade.

14. The developer amount regulation blade structure of claim 11, wherein:

the second supporting member has at least three cylindrical projections separated from each other in a longitudinal direction of the second supporting member, penetration holes having a diameter greater than an outer diameter of the cylindrical projections are formed in the regulation blade at the positions corresponding to the cylindrical projections, penetration holes having a diameter smaller than the outer diameter of the cylindrical projections are formed in the first supporting member at the positions corresponding to the cylindrical projections, the regulation blade being tightened between the first supporting member and the second supporting member by pressing the cylindrical projections in the penetration holes of the first supporting member through the penetration holes of the regulation blade, and the penetration holes of the first supporting member and at least two end cylindrical projections of the at least three cylindrical projections are plastically deformed.

15. The developer amount regulation blade structure of claim 11, wherein:

penetration holes having a diameter greater than an outer diameter of the cylindrical projections are formed in the regulation blade and the first supporting member at the positions corresponding to the cylindrical projections, and the regulation blade being tightened between the first supporting member and the second supporting member by inserting the cylindrical projections in the penetration holes of the first supporting member through the penetration holes of the regulation blade and by plastic deformation of heads of the cylindrical projections.

16. The developer amount regulation blade structure of claim 15, wherein beveling portions are formed in the penetration holes of the first supporting member at the opposite side of the regulation blade, and heads of the cylindrical projections of the first supporting member are plastically deformed to cover the beveling portions.

17. The developer amount regulation blade structure of claim 11, wherein:

the at least two cylindrical projections are formed by burring processing, penetration holes having a diameter greater than an outer diameter of the cylindrical projections are formed in the regulation blade and the first supporting member at the positions corresponding to the cylindrical projections, and the regulation blade being tightened between the first supporting member and the second supporting member by inserting the cylindrical projections in the penetration holes of the first supporting member through the penetration holes of the regulation blade and by plastic deformation of heads of the cylindrical projections.

* * * * *